US007520724B2

(12) United States Patent
Naik et al.

(10) Patent No.: US 7,520,724 B2
(45) Date of Patent: Apr. 21, 2009

(54) COOLED BLADE FOR A GAS TURBINE

(75) Inventors: Shailandra Naik, Gebenstorf (CH); Sacha Parneix, Mulhouse (FR); Ulrich Rathmann, Baden (CH); Helene Saxer-Felici, Mellingen (CH); Stefan Schlechtriem, Taegerig (CH); Beat Von Arx, Trimbach (CH)

(73) Assignee: Alstom Technology Ltd, Baden (CH)

( * ) Notice: Subject to any disclaimer, the term of this patent is extended or adjusted under 35 U.S.C. 154(b) by 173 days.

(21) Appl. No.: 11/483,091

(22) Filed: Jul. 10, 2006

(65) Prior Publication Data

US 2006/0292006 A1 Dec. 28, 2006

Related U.S. Application Data

(63) Continuation of application No. PCT/EP2005/050137, filed on Jan. 14, 2005.

(30) Foreign Application Priority Data

Jan. 16, 2004 (DE) ..... 10 2004 002 327

(51) Int. Cl.
*F01D 5/18* (2006.01)

(52) U.S. Cl. ..... 416/97 R

(58) Field of Classification Search ..... 416/92, 416/195

See application file for complete search history.

(56) References Cited

U.S. PATENT DOCUMENTS 4,278,400 A * 7/1981 Yamarik et al. ..... 416/97 R
5,915,923 A * 6/1999 Tomita et al. ..... 416/96 R
6,227,804 B1 * 5/2001 Koga et al. ..... 416/96 R
6,832,889 B1 * 12/2004 Lee et al. ..... 416/97 R
2005/0152785 A1 * 7/2005 McGrath et al. ..... 416/97 R
2005/0281674 A1 * 12/2005 Liang ..... 416/97 R

FOREIGN PATENT DOCUMENTS

EP 0 340 149 A1 11/1989
WO WO 95/14848 A1 6/1995

* cited by examiner

*Primary Examiner*—Richard Edgar
(74) *Attorney, Agent, or Firm*—Buchanan Ingersoll & Rooney PC

(57) ABSTRACT

A cooled blade for a gas turbine has a blade airfoil, which emerges from a blade root and a blade shank and has a leading edge and a trailing edge and, within the blade airfoil, a plurality of sequential coolant ducts, in terms of flow, extending in a radial direction. A first coolant duct along the leading edge, and a second coolant duct along the trailing edge, have a main flow of a coolant flowing through them from the blade root to the tip of the blade airfoil. An inlet of the first coolant duct is in connection with a main coolant inlet, and an outlet of the first coolant duct is in connection with the inlet to the second coolant duct via a first deflection region. A third coolant duct is arranged between the first and the second coolant duct and a second deflection region. An additional flow of cooler coolant provided from outside is added from the third coolant duct into the heated main flow of the coolant flowing into the second coolant duct. An orifice can, for example, extend from the main coolant inlet to the second deflection region.

16 Claims, 3 Drawing Sheets

COOLED BLADE FOR A GAS TURBINE

RELATED APPLICATIONS

The present application is a continuation application under 35 U.S.C. §120 of PCT/EP2005/050137 filed Jan. 14, 2005, which claims priority under 35 U.S.C. §119 to German Application No. 10 2004 002 327.1 filed Jan. 16, 2004, the contents of both documents being incorporated hereby by reference in their entireties.

TECHNICAL FIELD

A cooled blade for a gas turbine is disclosed.

Such a blade is known generally, for example, from the publication U.S. Pat. No. 4,278,400, the contents of which are hereby incorporated by reference in their entirety.

BACKGROUND INFORMATION

In modern high efficiency gas turbines, shrouded blades are employed which, during operation, are subjected to hot gases with temperatures of more than 1200° K and pressures of more than 6 bar.

A basic configuration of a shrouded blade is shown in FIG. 1. The blade 10 comprises a blade airfoil 11 which merges, in the downward direction, via a blade shank 25 into a blade root 12. At the upper end, at a blade tip or airfoil tip, the blade airfoil 11 merges into a shroud section 21 which, in the case of a complete blade row and together with the shroud sections of the other blades, forms a closed annular shroud. The blade airfoil has a spanwise direction extending from the blade shank to the blade tip. As, when the blade is inserted in a turbine, the spanwise direction is arranged in a radial direction of the turbine cross section, this direction may hereinafter also be referred to as a blade radial direction. The blade airfoil 11 has a leading edge 19, onto which the hot gas flows, and a trailing edge 20. Within the blade airfoil 11 are arranged a plurality of radial coolant ducts 13, 14 and 15 which are connected together, in terms of flow, by means of deflection regions 17, 18 and form a serpentine with a plurality of windings (see the flow arrows in the coolant ducts 13, 14, 15 of FIG. 1).

Because the coolant passes once through the serpentine-type sequentially connected coolant ducts 13, 14, 15, the coolant flows with increasing temperature through the coolant ducts and attains the maximum temperature in the last, trailing edge 20 coolant duct 15. The trailing edge 20 of the blade 10 can therefore, under certain operating conditions, attain excessively high coolant and blade material or metal temperatures. An incorrect matching of the metal temperature over the axial length of the blade can lead to high temperature creep and, in consequence, to deformation of the trailing edge 20. In the case of a shrouded blade, such as is shown in FIG. 1, tipping of the shroud segments 21 in the axial, radial and peripheral directions can occur as a secondary effect of the trailing edge deformation. The tipping of the shroud segments 21 can lead to opening of the gaps between individual shroud segments, which permits the entry of high temperature hot gas into the shroud space. As a consequence of this, the temperatures of the shroud metal can be significantly increased and rapidly introduce shroud creep and, finally, lead to high temperature failure of the shroud.

In the publication U.S. Pat. No. 4,278,400, cited at the beginning, a blade cooling supply has been proposed for blades with cooled tips and finely distributed cooling openings at the leading edge (film cooling). An ejector is arranged transverse to the flow direction of the main cooling flow at the end of a 90° deflection of the main cooling flow and, through this ejector, an additional flow of cooler coolant is injected into the coolant duct which runs along the trailing edge. The ejector can be supplied with coolant via a duct running radially through the root. The coolant emerging from the nozzle of the ejector with increased velocity can generate a depression, which can draw heated coolant from the coolant duct of the leading edge into the coolant duct of the trailing edge. Approximately 45% of the coolant flowing along the leading edge emerges through the cooling openings on the leading edge. 40% is induced by the injector. The rest emerges through cooling openings at the blade tip.

Due to the injector, the pressure relationships and flow relationships in the coolant duct can change relative to a configuration with simple supply through the inlet of the coolant duct on the leading edge. A balance between the coolant emerging at the leading edge for film cooling and the coolant induced by the injector will likely not exist, absent a completely new blade cooling design layout, which can be difficult to match to the changing requirements. The injector principle and the associated generation of depression are not suitable for blades without leading edge film cooling and blades with cooled shroud.

SUMMARY

A blade is disclosed which may be applied in shrouded or non-shrouded blades, such as blades comprising a cooled shroud, and without consideration whether film cooling of the leading edge is present or not. Already existing blades may easily be modified with the described blade.

In an exemplary blade, a supplemental coolant flow is branched off directly from the main coolant inlet and is fed into the coolant duct extending along the trailing edge via an orifice extending between the main coolant inlet and the second deflection region. The orifice may be a bore or a drilling, or may be cast. Because the flow of the coolant is branched off from the main cooling flow by the bypass orifice and is later fed back to it, the coolant flow remains unchanged overall.

An exemplary embodiment includes an orifice formed and arranged in such a way that the coolant flowing through the orifice flows directly through the second deflection region into the second coolant duct. This can provide a particularly efficient temperature reduction, due to the bypass flow, in the coolant duct of the trailing edge.

BRIEF DESCRIPTION OF THE FIGURES

Exemplary embodiments are explained in more detail below, in association with the drawings, wherein.

DETAILED DESCRIPTION

Figure 1:
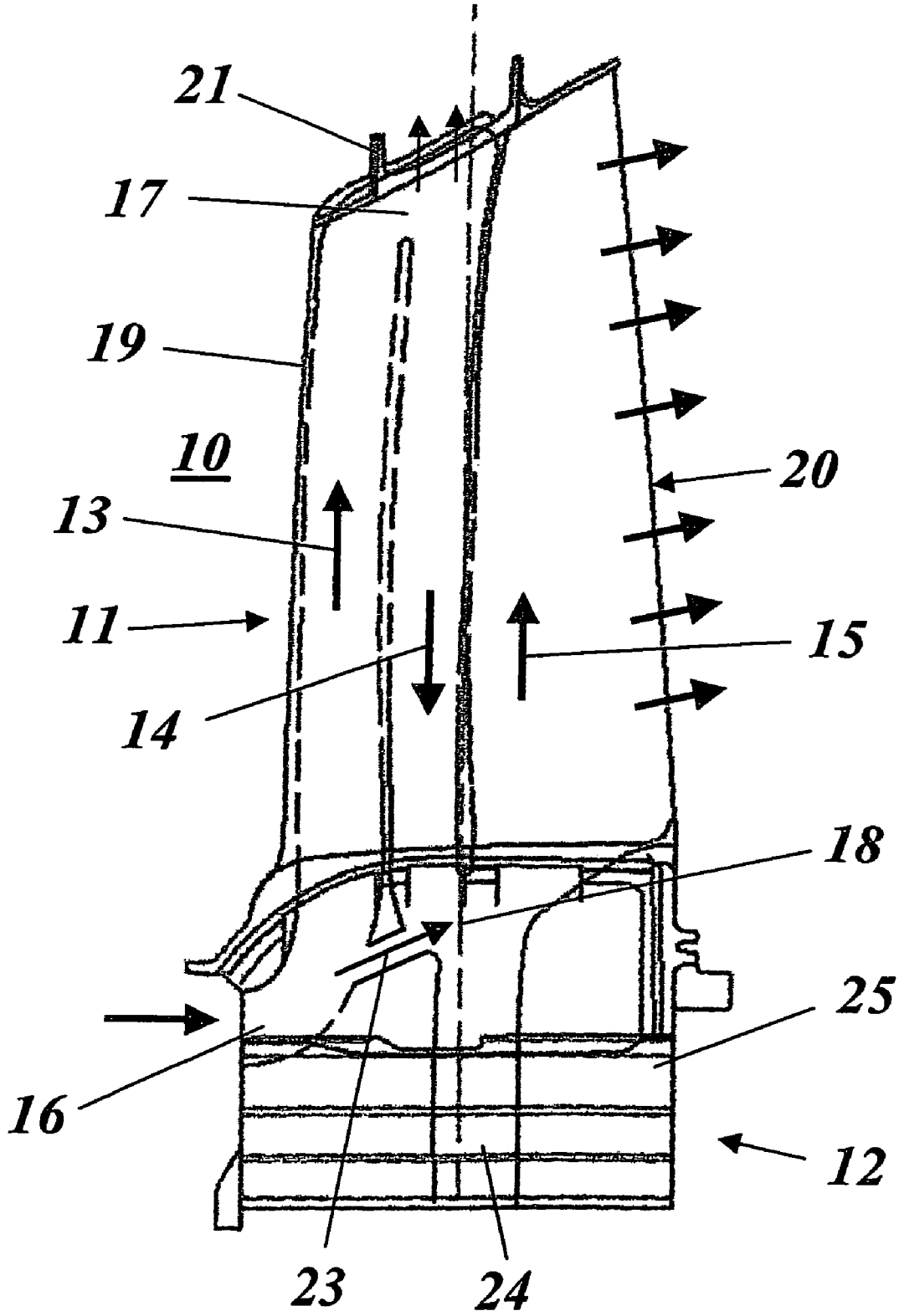
FIG. 1 shows, in longitudinal section, the configuration of an exemplary cooled gas turbine blade with a plurality of the coolant supply and cooled shroud.
Figure 2:
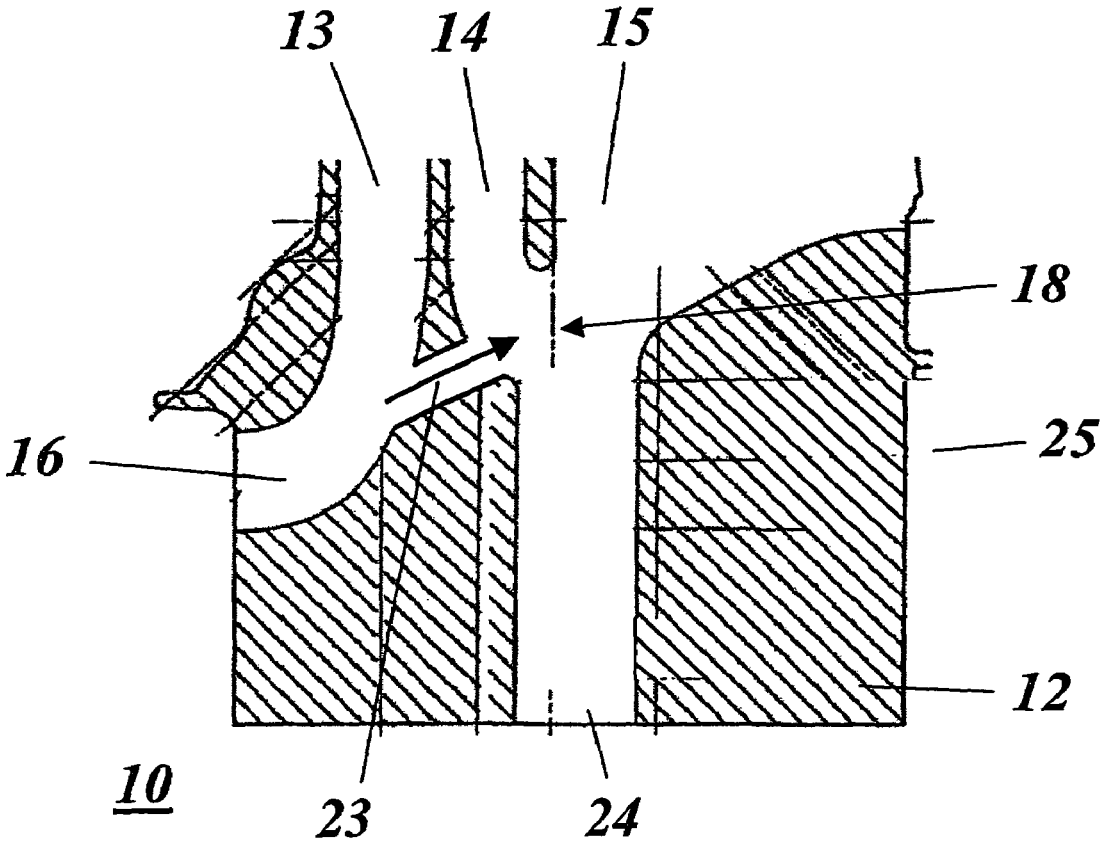
FIG. 2 shows, in an enlarged representation, the root (or base) region of the exemplary blade from FIG. 1 with the bypass orifice between the main coolant inlet and the second deflection region.
Figure 3:
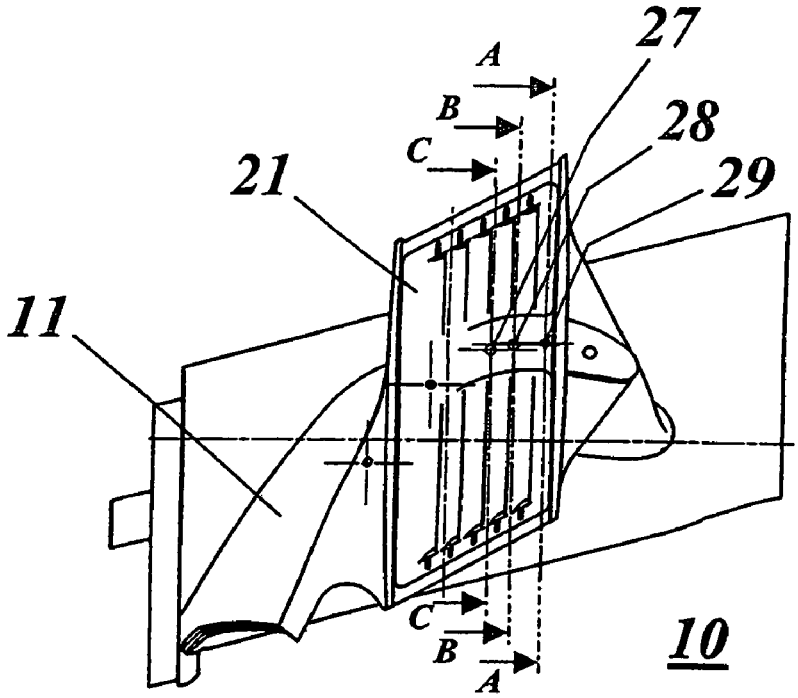
FIG. 3 shows, in the end view from above, the shroud section of the exemplary blade from FIGS. 1 and 2.
Figure 4:
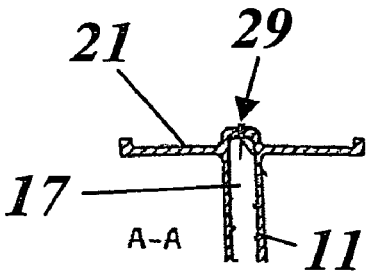
FIG. 4-6 show various sections through the shroud region of the exemplary blade from FIGS. 1 and 2 along the parallel section planes A-A, B-B and C-C included in FIG. 3.
Figure 5:
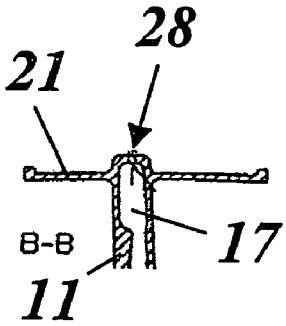
Figure 6:
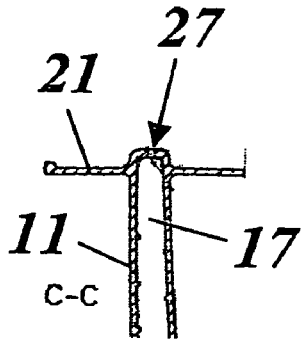

An exemplary embodiment of a cooled gas turbine blade with a plurality of coolant supply is shown in FIGS. 1 and 2. The main flow of the coolant enters the coolant duct 13 from below through a main coolant inlet 16 in the region of the blade shank 25 and part of it emerges again through openings in the shroud section 21 (orifices 27 . . . 29 in FIG. 3 to 6) and part of it along the trailing edge 20 (see the arrows included in FIG. 1 on the shroud section 21 and the trailing edge 20).

A part of the coolant flowing into the main coolant inlet 16 is branched off by an orifice 23 and supplied via the second deflection region 18 to the coolant duct 15 at the trailing edge. The orifice 23 can be configured and arranged in such a way (i.e. obliquely upward in the present case) that the coolant flow through it is guided without deviations directly into the coolant duct 15. The bypass orifice 23 can introduce cooler coolant directly into the trailing edge region of the blade 10.

Further orifices 27, 28, 29 can be provided in the shroud section 21 of the blade 10 (FIG. 3 to 6). The coolant emerging through the orifices 27, 28, 29 can be used for the active cooling of the shroud section 21. The cooling orifices 27, 28, 29 in the shroud section 21 can have an internal diameter in the range between 0.6 mm and 4 mm. All three orifices 27, 28, 29 are positioned and dimensioned on the shroud section 21 in such a way that a non-uniform jet penetration takes place into the main flow of the shroud cavity.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

List of reference numerals

| | |
|---|---|
| 10 | Blade |
| 11 | Blade airfoil |
| 12 | Blade root |
| 13, 14, 15 | Coolant duct |
| 16 | Main coolant inlet |
| 17, 18 | Deflection region |
| 19 | Leading edge |
| 20 | Trailing edge |
| 21 | Shroud section |
| 23 | Orifice |
| 24 | Core opening |
| 25 | Blade shank |
| 27 . . . 29 | Orifice |

What is claimed is:

1. A cooled blade for a gas turbine, the blade comprising:

a blade airfoil extending in a spanwise direction from a blade base and a blade shank to a blade tip, the blade airfoil having a leading edge and a trailing edge;

a plurality of coolant ducts arranged inside the blade airfoil, the coolant ducts being arranged serially in a flow direction, and extending in an spanwise direction of the blade airfoil from the blade shank region to the blade tip, a first of said coolant ducts extending along the leading edge and a second of said coolant ducts extending along the trailing edge, the first and second coolant ducts being arranged and adapted for passing a main flow of a coolant through them in the spanwise direction towards the blade tip;

an inlet of the first coolant duct connected with a main coolant inlet;

an outlet of the first coolant duct fluidly connected to an inlet of the second coolant duct via a first deflection region;

at least one third coolant duct arranged between the first and the second coolant ducts and a second deflection region, the second deflection region being arranged between the third coolant duct and the second coolant duct; and an orifice extending from the main coolant inlet to the second deflection region which is constructed and arranged to provide supplemental flow of coolant into a heated main coolant flow flowing from the third coolant duct towards the second coolant duct, wherein the orifice is angled obliquely upward relative to the axial direction.

2. The blade as claimed in claim 1, wherein the orifice is configured and arranged such that coolant flowing through the orifice flows directly through the second deflection region into the second coolant duct.

3. The blade as claimed in claim 1, wherein the orifice is a bore.

4. The blade as claimed in claim 1, comprising:

outlet openings arranged between the main coolant inlet and the second deflection region through which a part flow of the main coolant flow emerges.

5. The blade as claimed in claim 4, comprising:

a shroud section at the blade airfoil tip, the outlet openings being orifices arranged in the shroud section.

6. The blade as claimed in claim 5, comprising:

at least three orifices in the shroud section, which orifices have an internal diameter in the range between 0.6 mm and 4 mm.

7. The blade as claimed in claim 1, comprising:

exactly one third coolant duct.

8. The blade as claimed in claim 2, wherein the orifice is a bore.

9. The blade as claimed in claim 8, comprising:

outlet openings arranged between the main coolant inlet and the second deflection region through which a part flow of the main coolant flow emerges.

10. The blade as claimed in claim 9, comprising:

a shroud section at the blade airfoil tip, the outlet openings being orifices arranged in the shroud section.

11. The blade as claimed in claim 10, comprising:

at least three orifices in the shroud section, which orifices have an internal diameter in the range between 0.6 mm and 4 mm.

12. The blade as claimed in claim 2, comprising:

exactly one third coolant duct.

13. The blade as claimed in claim 3, comprising:

exactly one third coolant duct.

14. The blade as claimed in claim 11, comprising:

exactly one third coolant duct.

15. The blade as claimed in claim 10, wherein the orifices in the shroud section are positioned and dimensioned such that a non-uniform jet penetration takes place into a main flow of the shroud cavity.

16. The blade as claimed in claim 1, wherein the main coolant inlet faces the axial direction.

* * * * *